US008280636B2

(12) United States Patent
Newman

(10) Patent No.: US 8,280,636 B2
(45) Date of Patent: Oct. 2, 2012

(54) METHOD AND SYSTEM FOR CONTROLLING A WELL SERVICE RIG BASED ON LOAD DATA

(75) Inventor: Frederic M. Newman, Midland, TX (US)

(73) Assignee: Key Energy Services Inc., Houston, TX (US)

( * ) Notice: Subject to any disclaimer, the term of this patent is extended or adjusted under 35 U.S.C. 154(b) by 0 days.

(21) Appl. No.: 13/051,590

(22) Filed: Mar. 18, 2011

(65) Prior Publication Data

US 2011/0214856 A1 Sep. 8, 2011

Related U.S. Application Data

(62) Division of application No. 11/850,398, filed on Sep. 5, 2007, now Pat. No. 7,917,293.

(51) Int. Cl.
*G01V 1/40* (2006.01)
*E21B 19/22* (2006.01)
*B66D 1/00* (2006.01)

(52) U.S. Cl. ..... 702/6; 166/77.1; 254/264

(58) Field of Classification Search ..... 702/6, 1–2, 702/9, 33, 81, 84, 127, 173–177, 179, 182, 702/189, 199; 166/77.1, 77.4, 77.51, 77.53, 166/85.1; 177/1–13, 17, 26, 45, 58–60, 132–133, 177/136, 145–147; 254/264–266, 269, 276
See application file for complete search history.

(56) References Cited

U.S. PATENT DOCUMENTS

| | | | | |
|---|---|---|---|---|
| 2,176,885 | A | | 10/1939 | Cadwallader |
| 2,582,987 | A | | 1/1952 | Hagenbook |
| 3,917,230 | A | * | 11/1975 | Barron ..... 254/270 |
| 3,942,594 | A | | 3/1976 | Smith et al. |
| 4,128,888 | A | | 12/1978 | Sheldon et al. |
| 4,139,891 | A | | 2/1979 | Sheldon et al. |
| 4,187,546 | A | | 2/1980 | Heffernan et al. |
| 2004/0065874 | A1 | | 4/2004 | Newman |
| 2004/0068394 | A1 | | 4/2004 | Maekawa et al. |
| 2005/0199388 | A1 | | 9/2005 | Newman |
| 2005/0216116 | A1 | | 9/2005 | Nield |
| 2007/0056727 | A1 | | 3/2007 | Newman |

OTHER PUBLICATIONS

Luke et al., Determination of True Hook Load and Line Tension under Dynamic Conditions, Dec. 1993, SPE Drilling & Completion, pp. 259-264.*

Baumert et al., Real-Time Monitoring for Quality Delivery of Directional Drilling Installations, Mar. 2003, Journal of Infrastructure Systems, ASCE, pp. 35-43.

PCT/US2008/075200 International Search Report, Nov. 18, 2008, International Searching Authority.

* cited by examiner

*Primary Examiner* — Toan M Le

(74) *Attorney, Agent, or Firm* — King & Spalding LLP

(57) ABSTRACT

The present invention is directed to methods for controlling the operations of a well service rig at a well site by evaluating load sensor data obtained from sensors on or associated with the well service rig. A rig load data chart can be reviewed and an average rig load can be determined for each pull of tubing or rods from a well. The average rig load can be used to calculate and set a rig overload level. If the rig load sensor reads a rig load at or above the rig overload level, the clutch for the hoist can be disengaged and the brake applied to prevent the load from either damaging the rig or breaking off the tubing or rods in the well. In addition, the rig load can be evaluated to determine when the limit the block speed when pulling rods or tubing.

20 Claims, 15 Drawing Sheets

METHOD AND SYSTEM FOR CONTROLLING A WELL SERVICE RIG BASED ON LOAD DATA

CROSS REFERENCE TO RELATED APPLICATIONS

This patent application is a divisional of and claims priority under 35 U.S.C. §§120 and 121 to U.S. patent application Ser. No. 11/850,398 (now U.S. Pat. No. 7,917,293), titled "Method and System for Controlling a Well-Service Rig Based on Load Data" filed on Sep. 5, 2007, and issued on Mar. 29, 2011, the entire contents of each of which are hereby incorporated herein by reference.

FIELD OF THE INVENTION

The present invention generally pertains to equipment used for repairing wells that have already been drilled. More specifically the present invention pertains to an analysis of rig loads and rig load data to determine and monitor tubing and/or rod removal overload conditions on a well service rig.

BACKGROUND OF THE INVENTION

After a well has been drilled, it must be completed before it can produce gas or oil. Once completed, a variety of events may occur to the formation causing the well and its equipment to require a "work-over." For purposes of this application, "work-over" and "service" operations are used in their very broadest sense to refer to any and all activities performed on or for a well to repair or rehabilitate the well, and also includes activities to shut in or cap the well. Generally, work-over operations include such things as replacing worn or damaged parts (e.g., a pump, sucker rods, tubing, and packer glands), applying secondary or tertiary recovery techniques, such as chemical or hot oil treatments, cementing the wellbore, and logging the wellbore, to name just a few. Service operations are usually performed by or involve a mobile work-over or well service rig (collectively hereinafter "service rig" or "rig") that is adapted to, among other things, pull the well tubing or rods and also to run the tubing or rods back in to the well. Typically, these mobile service rigs are motor vehicle-based and have an extendible, jack-up derrick complete with draw works and block.

During rod or tubing removal, a rig operator typically lifts a stand of tubing (or rods) which is then held in place by slips (or elevators for rods) while the stand is separated from the remaining portion of the tubing or rod string in the well. Once the stand of tubing has been separated from that which is still in the well, the stand of tubing can be placed on a tubing board. During the initial lifting operation, the weight or load on the hook can fluctuate greatly based on the weight of the tubing string in the well, the conditions within the well, the condition of the tubing string, and the amount of acceleration of the tubing string. In general the tubing string acts similarly to a rubber band. As the operator begins to accelerate the block upward and pull the tubing string out of the well. the tubing string initially becomes elongated for a short interval before the entire tubing string begins to move upward through the well. The same elongation can occur when a portion of the tubing string encounters a part of the well with increased friction or gets snagged or stuck within a portion of the well. If the operator does not recognize the problem quickly enough, the amount of load on the hook ("hookload") can increase very quickly to a level that is above the safe operating level of the rig. While alarms can be employed, if the operator cannot act quickly enough, the rig may be damaged and workers around the well could be injured.

In addition, as the stands of tubing (or rods) are being pulled out of the well, the total amount of weight on the string is reduced and the length of the string is reduced. When there are only a few stands of tubing left in the well, pulling the tubing out at a typical rate of speed, for example, six feet per second, can become more dangerous because if the tubing snags or drags in the well there is less overall elasticity within the remaining length of tubing, and therefore, less time to react to the increase in hookload. This can cause dangerous conditions around the wellhead.

Furthermore, while a stand of tubing (or rods) is being decoupled from the remaining string in the well, the operator brings his engine RPM up to drive the tongs that are used to unscrew the tubing from one another. When the previously pulled stand of tubing is fully disengaged from the remaining tubing in the well, the operator engages the clutch for the hoist and lifts the stand of tubing about another foot or two and places it onto the tubing board. The lifting of the stand of tubing that small distance prior to placement on the tubing board can cause a small spike in the rig load recorded at the rig load sensors. Much of this spike is caused by the acceleration of the block by the operator. Unfortunately, at times, the operator is in a hurry or is not cautious enough and can begin lifting the stand of tubing before the stand has been fully unscrewed from the tubing that remains in the well. When this occurs the rig load will suddenly and violently increase. The rig load can continue to increase until the stand of tubing breaks free of the final threads of the tubing at the wellhead. When the stand breaks free anyone in the vicinity of the wellhead is in danger of serious injury.

What is needed is a method and apparatus for evaluating the rig load or hookload of a service rig when removing tubing or rods from a well and disengaging the clutch for the hoist when the rig load reaches a level indicative of a problem with the tubing in the well, such as a snag or hang up. Furthermore, what is needed is a method and apparatus for evaluating the rig load or hookload of a tubing or rod string being removed from a well and limiting the speed of the block and hoist when only a small amount of tubing or rods remains in the well. In addition, what is needed is a method and apparatus for determining when a stand of tubing or rods is being decoupled from tubing or rods remaining in the well during a pull operation and preventing or limiting the ability for the block and hoist to lift the stand if the stand is not fully disengaged from the remaining tubing or rods in the well.

The present invention is directed to solving these as well as other similar issues in the well service area.

SUMMARY OF THE INVENTION

The present invention is directed to controlling the operation of a well service rig based on rig load data. By removing the need for or limiting the capabilities of the operator during situations of increased load on the well service rig the ability to prevent damage to the service rig and injury to the workers around the well head can be improved. Furthermore, by limiting the speed of the well service rig during periods where only a small amount of tubing or rods remains to be pulled out of a wellbore, the opportunity for a dangerous situation caused by the tubing or rod hanging or getting caught up in the wellbore is reduced based on the fact that reaction time is increased at the slower speeds.

For one aspect of the present invention, a method for determining the average load during the pulling of a stand of rods or tubing can be achieved by monitoring the load data of a well service rig. The load data can be received during the removal process from sensors on the well service rig that transmit inputs to a computer or monitor on the rig. The computer can calculate the average load during the pull of a stand of tubing or rods based on the load data received from sensors. The load data can include the hookload or the load of the rig. The upper load limit can then be determined based on the computation of the average load. The upper load limit can be a fixed amount above the average load for each pull of a stand of tubing or rods or a percentage of the hookload or rig load. The upper load limit can then be set for the next pull of a stand of pipe from the well. The pipe can include, but is not limited to, pipe, well casing, rods, tubing, or other tubulars.

For another aspect of the present invention, a method for determining when to reduce or limit block and/or hoist speed during a pulling operation can be achieved based on an evaluation of hook load data. Load data can be received from sensors on the well service rig related to load calculations taken during the removal of a pipe string from a well. The hookload or rig load can be calculated based on the load data. An evaluation of the hookload or rig load can be conducted to determine if the load has fallen to or below a certain level. That level can be indicative that the weight of the remaining pipe string in the well is much less than when the pull operation first began. If the load is below a certain level, the speed of the block or the hoist can be limited to an speed that is substantially slower than the normal operation of the block and hoist during a standard pulling operation. The reduced speed can increase reaction time in case the pipe string becomes caught in the well.

For still another aspect of the present invention, a method for preventing a well service rig from pulling a stand of pipe away from a pipe string while the stand of pipe is still engaged with the threads of the pipe string can be achieved based on an evaluation of rig load or hookload data. The system can receive information indicating that the rig is disengaging a stand of pipe from a pipe string, such as through the use of tongs. Load data, such as rig load or hookload data can be received when the stand of pipe is being disengaged from the pipe string. An evaluation of the load data can be conducted to determine if the load data has increased above a certain level that is indicative of a stand of pipe being pulled up before the de-threading process has occurred from the pipe string. If the load level has increased to or above a certain level, the clutch for the drive system that is raising the stand of pipe can be disengaged automatically or the throttle can be reduced to prohibit over pulling.

BRIEF DESCRIPTION OF DRAWINGS

For a more complete understanding of the exemplary embodiments of the present invention and the advantages thereof, reference is now made to the following description in conjunction with the accompanying drawings in which.

DETAILED DESCRIPTION OF THE EXEMPLARY EMBODIMENTS

Exemplary embodiments of the invention will now be described in detail with reference to the included figures. The exemplary embodiments are described in reference to how they might be implemented. In the interest of clarity, not all features of an actual implementation are described in this specification. Those of ordinary skill in the art will appreciate that in the development of an actual embodiment, several implementation-specific decisions must be made to achieve the inventors' specific goals, such as compliance with system-related and business-related constraints which can vary from one implementation to another. Moreover, it will be appreciated that such a development effort might be complex and time-consuming, but would nevertheless be a routine undertaking for those of ordinary skill in the art having benefit of this disclosure. Further aspects and advantages of the various figures of the invention will become apparent from consideration of the following description and review of the figures.

Figure 1:
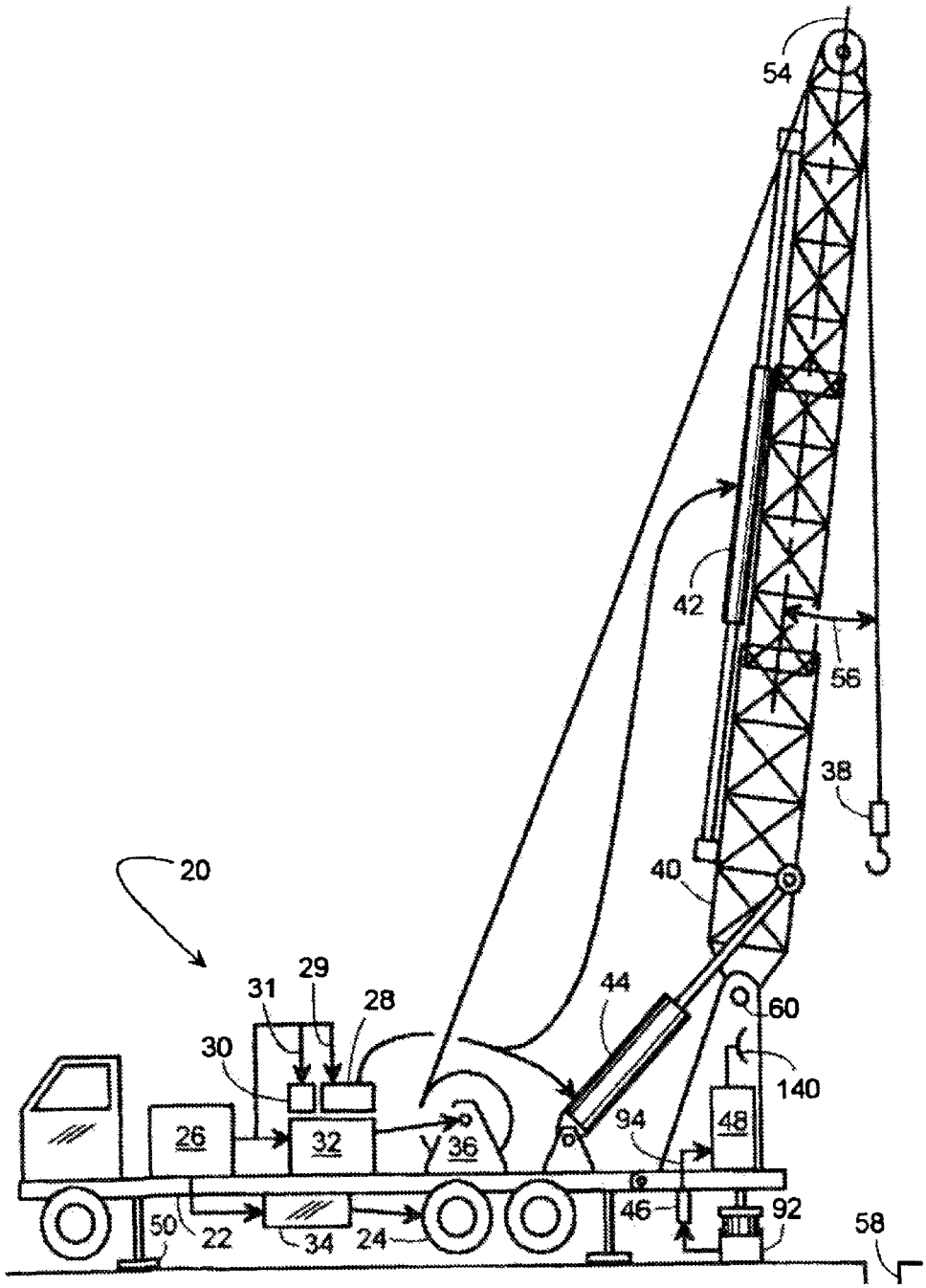
FIG. 1 is a side view of an exemplary mobile repair unit with its derrick extended according to one exemplary embodiment of the present invention.
Figure 5:
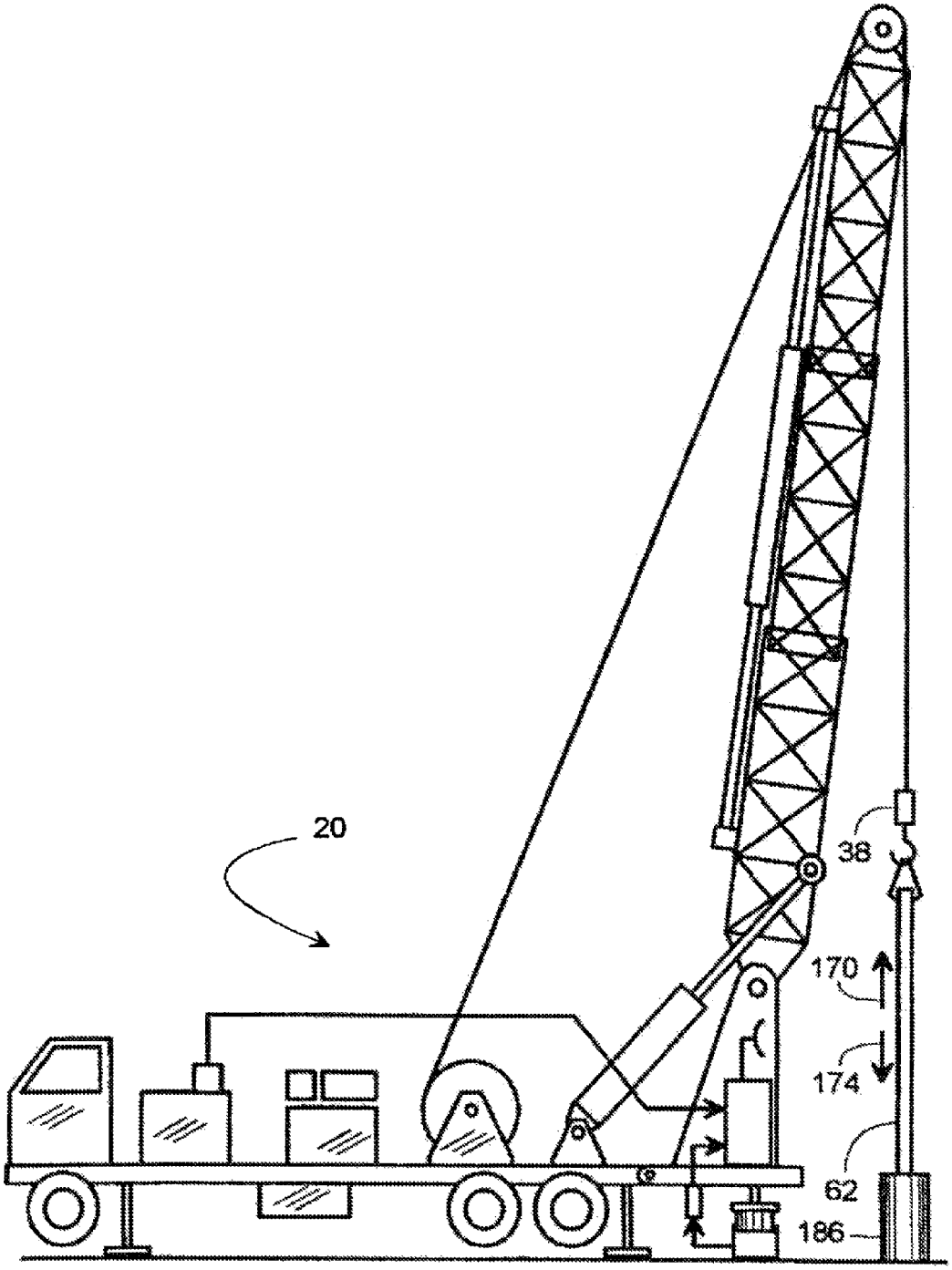
FIG. 5 illustrates the raising and lowering of an inner tubing string with an exemplary mobile repair unit according to one exemplary embodiment of the present invention.

Referring to FIGS. 1 and 5, a retractable, self-contained mobile repair unit 20 is shown to include a truck frame 22 supported on wheels 24, an engine 26, a hydraulic pump 28, an air compressor 30, a first transmission 32, a second transmission 34, a variable speed hoist 36, a block 38, an extendible derrick 40, a first hydraulic cylinder 42, a second hydraulic cylinder 44, a first transducer 46, a monitor 48, and retractable feet 50.

Figure 2:
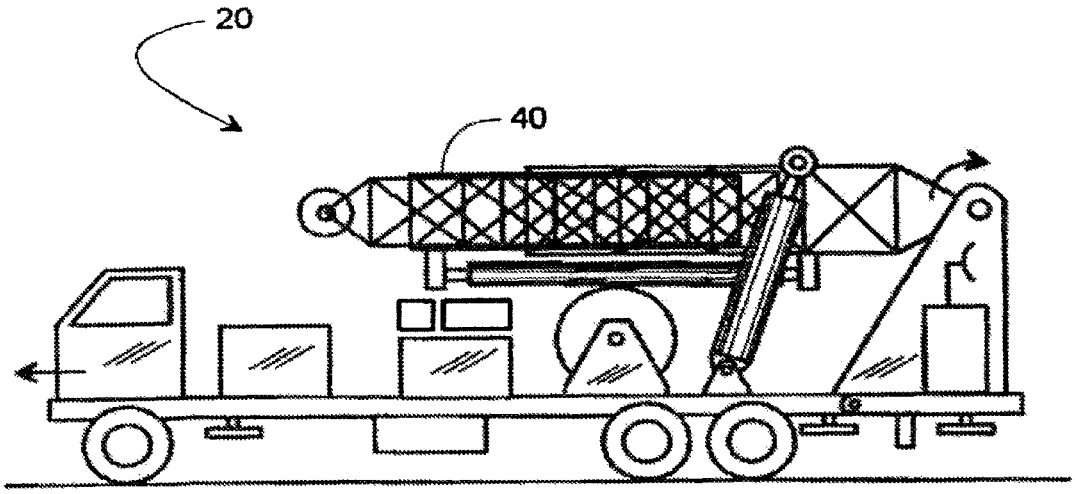
FIG. 2 is a side view of the exemplary mobile repair unit with its derrick retracted according to one exemplary embodiment of the present invention.

The engine 26 selectively couples to the wheels 24 and the hoist 36 by way of the transmissions 34 and 32, respectively. The engine 26 also drives the hydraulic pump 28 via the line 29 and the air compressor 30 via the line 31. The compressor 30 powers a pneumatic slip (Not Shown), and pump powers a set of hydraulic tongs (Not Shown). The pump 28 also powers the cylinders 42 and 44 which respectively extend and pivot the derrick 40 to selectively place the derrick 40 in a working position, as shown in FIG. 1, and in a lowered position, as shown in FIG. 2. In the working position, the derrick 40 is pointed upward, but its longitudinal centerline 54 is angularly offset from vertical as indicated by the angle 56. The angular offset provides the block 38 access to a wellbore 58 without interference with the derrick pivot point 60. With the angular offset 56, the derrick framework does not interfere with the typically rapid installation and removal of numerous inner pipe segments (known as pipe, inner pipe string, rods, or tubing 62, hereinafter "tubing" or "rods").

Individual pipe segments (of string 62) and sucker rods are screwed to themselves using hydraulic tongs. The term "hydraulic tongs" used herein and below refer to any hydraulic tool that can screw together two pipes or sucker rods. An example would include those provided by B.J. Hughes company of Houston, Tex. In operation, the pump 28 drives a hydraulic motor (Not Shown) forward and reverse by way of a valve. Conceptually, the motor drives the pinions which turn a wrench element relative to a clamp. The element and clamp engage flats on the mating couplings of a sucker rod or inner pipe string 62 of one conceived embodiment of the invention. However, it is well within the scope of the invention to have rotational jaws or grippers that clamp on to a round pipe (i.e., no flats) similar in concept to a conventional pipe wrench, but with hydraulic clamping. The rotational direction of the motor determines assembly or disassembly of the couplings.

While not explicitly shown in the figures, when installing the tubing segments 62, the pneumatic slip is used to hold the tubing 62 while the next segment of tubing 62 is screwed on using tongs. A compressor 30 provides pressurized air through a valve to rapidly clamp and release the slip. A tank helps maintain a constant air pressure. Pressure switch provides monitor 48 (FIG. 3) with a signal that indirectly indicates that rig 20 is in operation.

Figure 3:
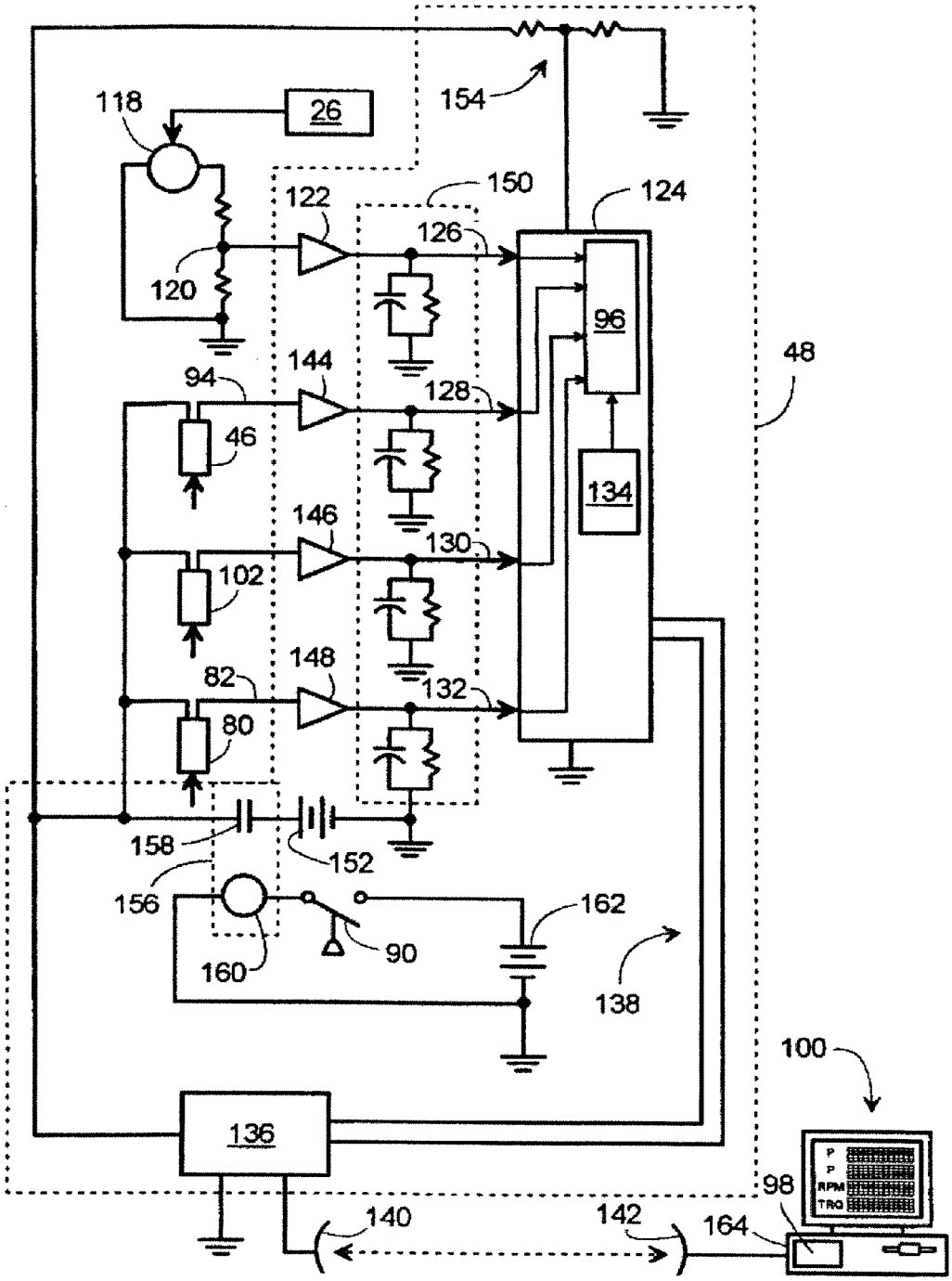
FIG. 3 is an electrical schematic of a monitor circuit according to one exemplary embodiment of the present invention.

Referring back to FIG. 1, weight applied to the block 38 is sensed by way of a hydraulic pad 92 that supports the weight of the derrick 40. The hydraulic pad 92 is basically a piston within a cylinder (alternatively a diaphragm) such as those provided M.D. Totco company of Cedar Park, Tex. Hydraulic pressure in the pad 92 increases with increasing weight on the block 38. In FIG. 3, the first transducer 46 converts the hydraulic pressure to a 0-5 VDC signal 94 that is conveyed to the monitor 48. Alternatively, the first transducer 46 can convert the hydraulic pressure into a 4-20 milliamp signal. The monitor 48 converts signal 94 to a digital value, stores it in a memory 96, associates it with a real time stamp, and eventually communicates the data to a remote computer 100 or the computer 705, of FIG. 7, by way of hardwire, a modem 98, T1 line, WiFi or other device or method for transferring data known to those of ordinary skill in the art.

Figure 4:
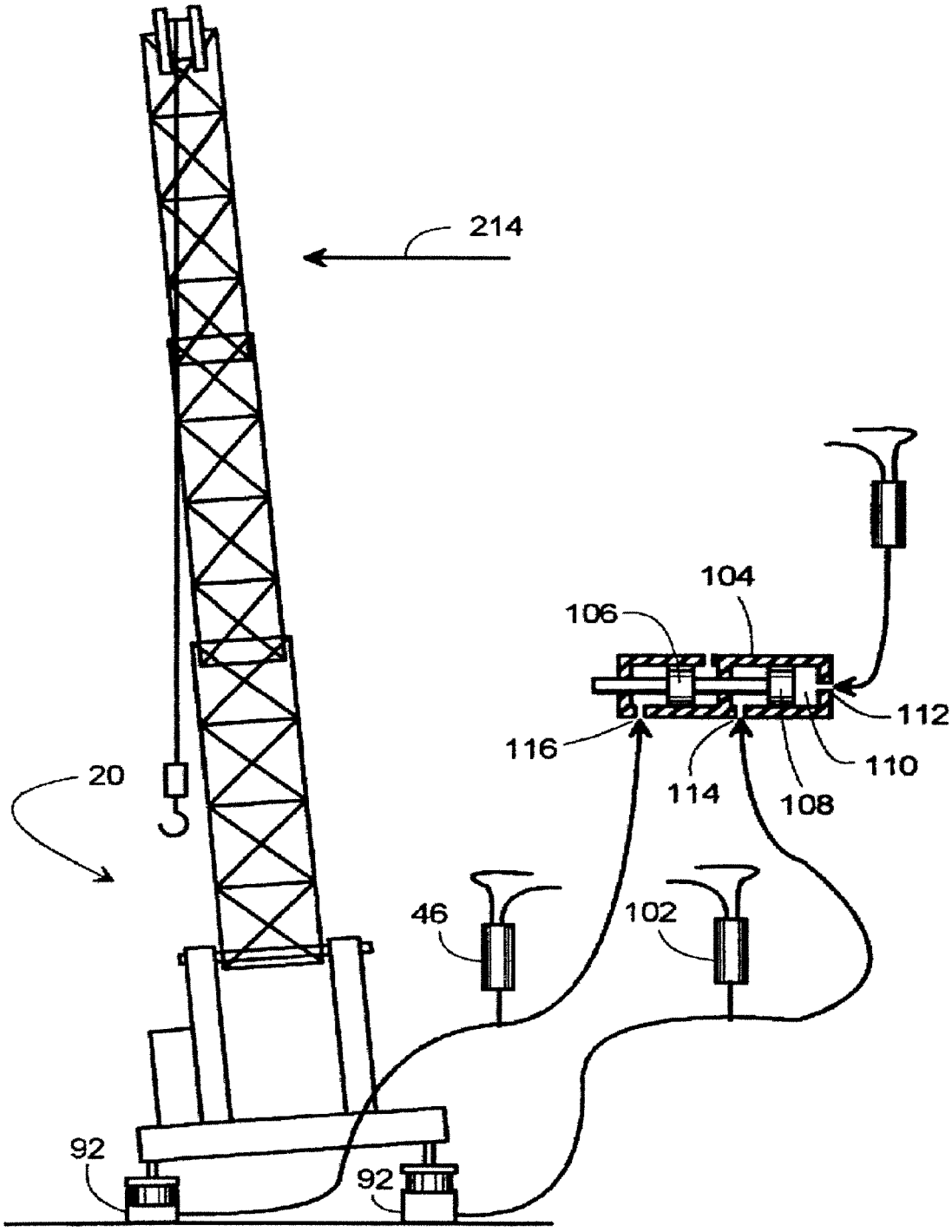
FIG. 4 is an exemplary end view of an imbalanced derrick according to one exemplary embodiment of the present invention.

In the embodiment of FIG. 4, two pads 92 associated with two transducers 46 and 102 are used. An integrator 104 separates the pads 92 hydraulically. The rod side of the pistons 106 and 108 each have a pressure exposed area that is half the full face area of the piston 108. Thus, the chamber 110 develops a pressure that is an average of the pressures in the pads 92. One type of integrator 104 is provided by M.D. Totco company of Cedar Park, Tex. In one embodiment of the present invention, just one transducer 46 is used and it is connected to the port 112. In another embodiment of the present invention, two transducers 46 and 102 are used, with the transducer 102 on the right side of the rig 20 coupled to the port 114 and the transducer 46 on the left side coupled to the port 116. Such an arrangement allows one to identify an imbalance between the two pads 92. While the foregoing has described the use of a pad 92 to determine load data, those of ordinary skill in the art will recognize that other types of load gauges can be used, including, but not limited to, strain gauges, line indicators and the like.

Returning to FIG. 3, transducers 46 and 102 are shown coupled to the monitor 48. The transducer 46 indicates the pressure on the left pad 92 and the transducer 102 indicates the pressure on the right pad 92. A generator 118 driven by the engine 26 provides an output voltage proportional to the engine speed. This output voltage is applied across a dual-resistor voltage divider to provide a 0-5 VDC signal at point 120 and then passes through an amplifier 122. A generator 118 represents just one of many various tachometers that provide a feedback signal proportional to the engine speed. Another example of a tachometer would be to have engine 26 drive an alternator and measure its frequency. The transducer 80 provides a signal proportional to the pressure of hydraulic pump 28, and thus proportional to the torque of the tongs.

A telephone accessible circuit 124, referred to as a "POCKET LOGGER" by Pace Scientific, Inc. of Charlotte, N.C., includes four input channels 126, 128, 130 and 132; a memory 96 and a clock 134. The circuit 124 periodically samples inputs 126, 128, 130 and 132 at a user selectable sampling rate; digitizes the readings; stores the digitized values; and stores the time of day that the inputs were sampled. It should be appreciated by those skilled in the art that with the appropriate circuit, any number of inputs can be sampled and the data could be transmitted instantaneously upon receipt.

A supervisor at a computer 100 remote from the work site at which the service rig 20 is operating accesses the data stored in the circuit 124 by way of a PC-based modem 98 and a cellular phone 136 or other known methods for data transfer. The phone 136 reads the data stored in the circuit 124 via the lines 138 (RJ11 telephone industry standard) and transmits the data to the modem 98 by way of antennas 140 and 142. In an alternative embodiment the data is transmitted by way of a cable modem or WiFi system (Not Shown). In one exemplary embodiment of the present invention, the phone 136 includes a CELLULAR CONNECTION™ provided by Motorola Incorporated of Schaumburg, Ill. (a model S1936C for Series II cellular transceivers and a model S1688E for older cellular transceivers).

Some details worth noting about the monitor 48 is that its access by way of a modem makes the monitor 48 relatively inaccessible to the crew at the job site itself. However the system can be easily modified to allow the crew the capability to edit or amend the data being transferred. The amplifiers 122, 144, 146 and 148 condition their input signals to provide corresponding inputs 126, 128, 130 and 132 having an appropriate power and amplitude range. Sufficient power is needed for RC circuits 150 which briefly (e.g., 2-10 seconds) sustain the amplitude of inputs 126, 128, 130 and 132 even after the outputs from transducers 46, 102 and 80 and the output of the generator 118 drop off. This ensures the capturing of brief spikes without having to sample and store an excessive amount of data. A DC power supply 152 provides a clean and precise excitation voltage to the transducers 46, 102 and 80; and also supplies the circuit 124 with an appropriate voltage by way of a voltage divider 154. A pressure switch 90 enables the power supply 152 by way of the relay 156, whose contacts 158 are closed by the coil 160 being energized by the battery 162. FIG. 5 presents an exemplary display representing a service rig 20 lowering an inner pipe string 62 as represented by arrow 174 of FIG. 5.

Figure 6:
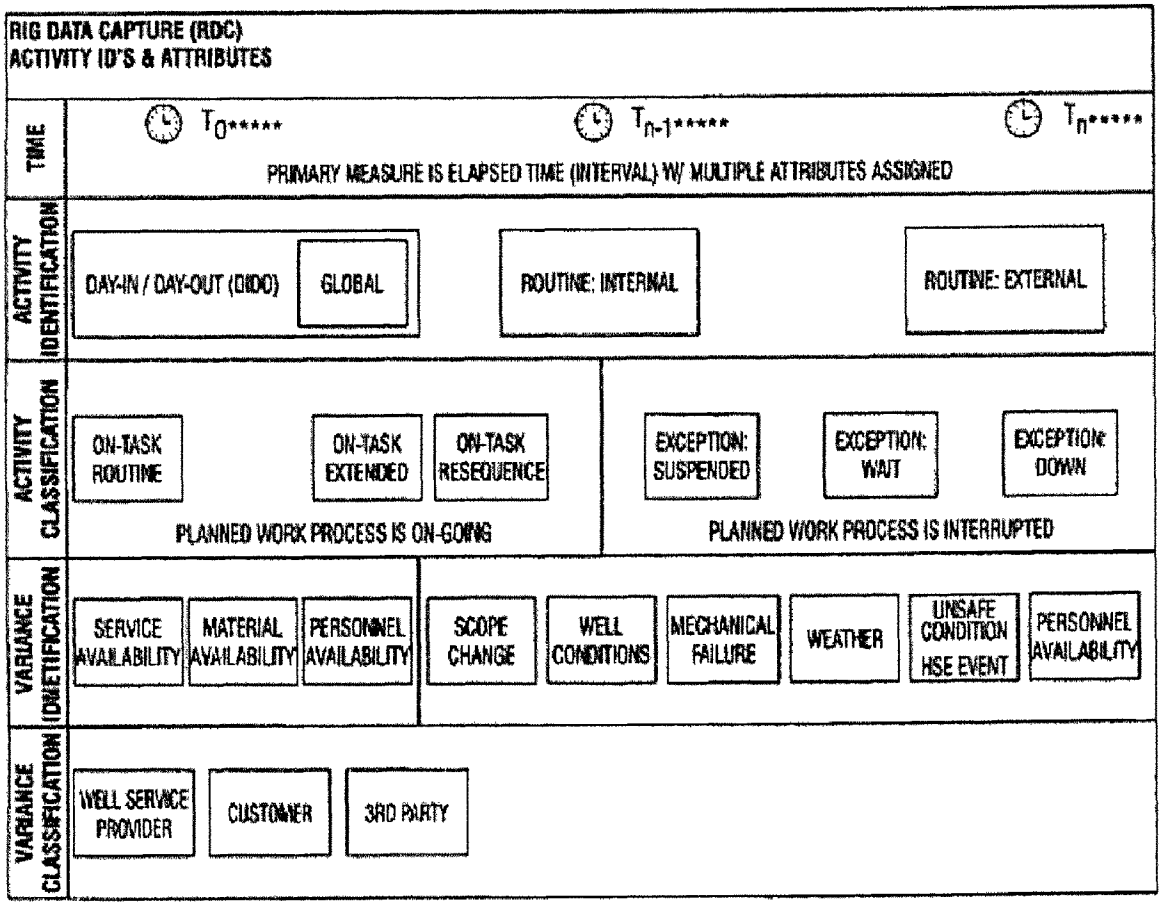
FIG. 6 illustrates one embodiment of an activity capture methodology outlined in tabular form according to one exemplary embodiment of the present invention.

FIG. 6 provides an illustration of an activity capture methodology in tabular form according to one exemplary embodiment of the present invention. Now referring to FIG. 6, an operator first chooses an activity identifier for his/her upcoming task. If "GLOBAL" is chosen, then the operator would choose from rig up/down, pull/run tubing or rods, or laydown/pickup tubing and rods (options not shown in FIG. 6). If "ROUTINE: INTERNAL" is selected, then the operator would choose from rigging up or rigging down an auxiliary service unit, longstroke, cut paraffin, nipple up/down a BOP, fishing, jarring, swabbing, flowback, drilling, clean out, well control activities such as killing the well or circulating fluid, unseating pumps, set/release tubing anchor, set/release packer, and pick up/laydown drill collars and/or other tools. Finally, if "ROUTINE: EXTERNAL" is chosen, the operator would then select an activity that is being performed by a third party, such as rigging up/down third party servicing equipment, well stimulation, cementing, logging, perforating, or inspecting the well, and other common third party servicing tasks. After the activity is identified, it is classified. For all classifications other than "ON TASK: ROUTINE," a variance identifier is selected, and then classified using the variance classification values.

Figure 7:
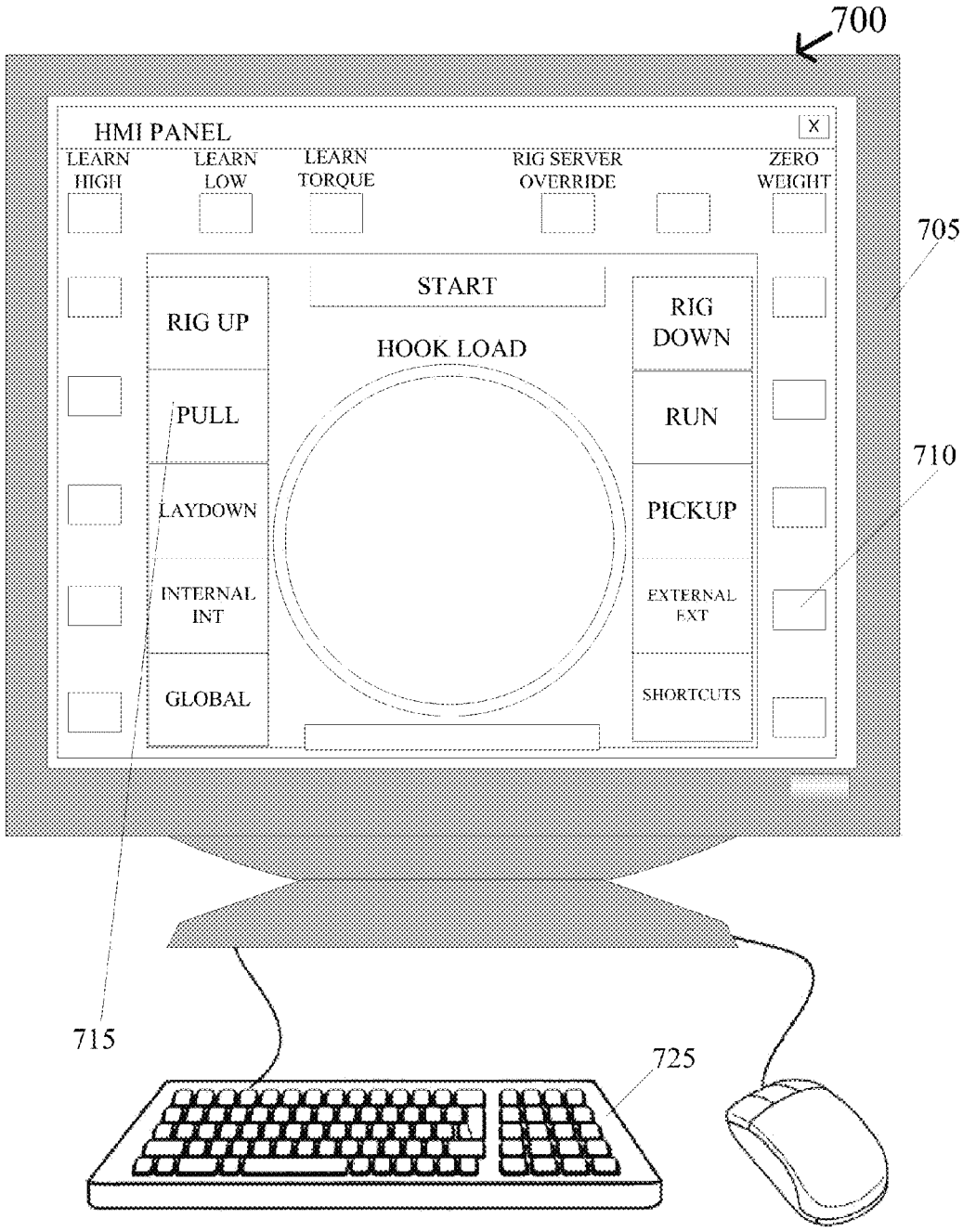
FIG. 7 provides a frontal view of an exemplary operator interface according to one exemplary embodiment of the present invention.

FIG. 7 provides a view of an rig operator interface or supervisor interface according to one exemplary embodiment of the present invention. Now referring to FIG. 7, all that is required from the operator is that he or she input in the activity data into a computer 705. The operator can interface with the computer 705 using a variety of means, including typing on a keyboard 725 or using a touch-screen 710. In one embodiment, a display 710 with pre-programmed buttons, such as pulling rods or tubing from a wellbore 715, is provided to the operator, as shown in FIG. 7, which allows the operator to simply select the activity from a group of pre-programmed buttons. For instance, if the operator were presented with the display 710 of FIG. 7 upon arriving at the well site, the operator would first press the "RIG UP" button. The operator would then be presented with the option to select, for example, "SERVICE UNIT," "AUXILIARY SERVICE UNIT," or "THIRD PARTY." The operator then would select whether the activity was on task, or if there was an exception, as described above. In addition, as shown in FIG. 7, prior to pulling (removing) 715 or running (inserting) tubing 62, the operator could set the high and low limits for the block 38 by pressing the learn high or learn low buttons after moving the block 38 into the proper position.

Processes of exemplary embodiments of the present invention will now be discussed with reference to FIGS. 8, 10, 12, 14, and 15. Certain steps in the processes described below must naturally precede others for the present invention to function as described. However, the present invention is not limited to the order of the steps described if such order or sequence does not alter the functionality of the present invention in an undesirable manner. That is, it is recognized that some steps may be performed before or after other steps or in parallel with other steps without departing from the scope and spirit of the present invention.

Figure 8:
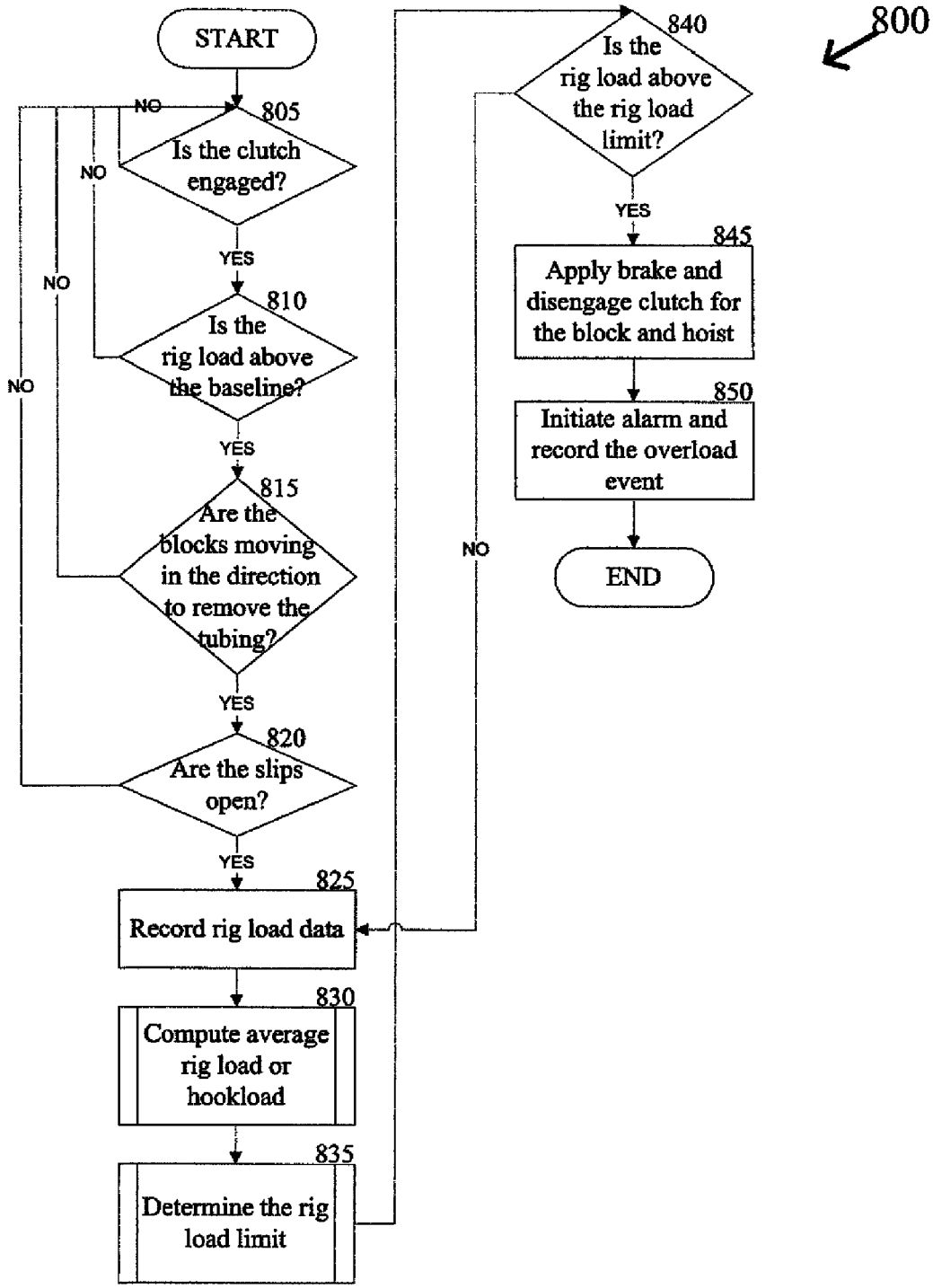
FIG. 8 is a flowchart of an exemplary process for identifying a rig load or hookload over limit event according to one exemplary embodiment of the present invention.

Turning now to FIG. 8, a logical flowchart diagram illustrating an exemplary method 800 for identifying an over load limit event on a service rig 20 based on an evaluation of the rig load data chart is presented according to one exemplary embodiment of the present invention. Referring to FIGS. 1, 3, 5, 7, 8, and 9, the exemplary method 800 begins at the START step and continues to step 805, where an inquiry is conducted to determine if the drum clutch for the variable speed hoist 36 is engaged. If the clutch is not engaged, the "NO" branch is followed back to step 805 until a determination is made that the clutch is engaged. Otherwise, the "YES" branch is followed to step 810.

In step 810, an inquiry is conducted to determine if the rig load weight is above the baseline weight or load level. The baseline weight is generally at a level that is marginally above the weight of the rig itself. In one exemplary embodiment, the baseline weight is approximately 40,000 pounds. However, those of skill in the art will recognize that this amount may be easily changed based on other factors, such as rig size, well conditions, etc. In an alternative embodiment, there may not be a need for an evaluation of the baseline weight, as any rig load limit weight will generally be above the baseline weight. If the weight is not above the baseline weight, the "NO" branch is followed back to step 805. On the other hand, if the rig load weight is above the baseline weight, the "YES" branch is followed to step 815.

In step 815, an inquiry is conducted to determine if the blocks 38 are moving in the direction to remove tubing 62 from the wellbore 58. In one exemplary embodiment, the direction of the blocks 38 can be analyzed by positioning an encoder (Not Shown) at the hoist 36 or at another position along the line coupled to the block 38. If the block 38 is not moving in the direction for removing the tubing 62, the "NO" branch is followed to step 805. Otherwise, the "YES" branch is followed to step 820.

In step 820, an inquiry is conducted to determine if the slips at the wellhead 68 are open. The slips are used when pulling tubing 62 out of the well 58. When the tubing 62 is being pulled out and it is time to unscrew one stand of tubing 62 from another, the tubing 62 is set on the slips, which suspend the remaining tubing 62 at the wellhead 186 and down in the wellbore 58. In one exemplary embodiment, the slips are engaged into position through the use of pneumatic pressure. IN this exemplary embodiment, the position of the slips can be determined through the use of a pneumatic switch that sense if opening or closing air pressure is being applied to the slips. In an alternative embodiment, the position of the slips can be evaluated using a slip sensor to evaluate and open/closed position. In this embodiment, the slip sensor can include a pressure-type input/output switch. Those of ordinary skill in the art will recognize that other methods of determine the position of the slips can also be employed, including photoeyes, proximity sensors and other positional indicators. If the slips are not open, the "NO" branch is followed to step 805. If the slips are open, the "YES" branch is followed to step 825.

Figure 9:
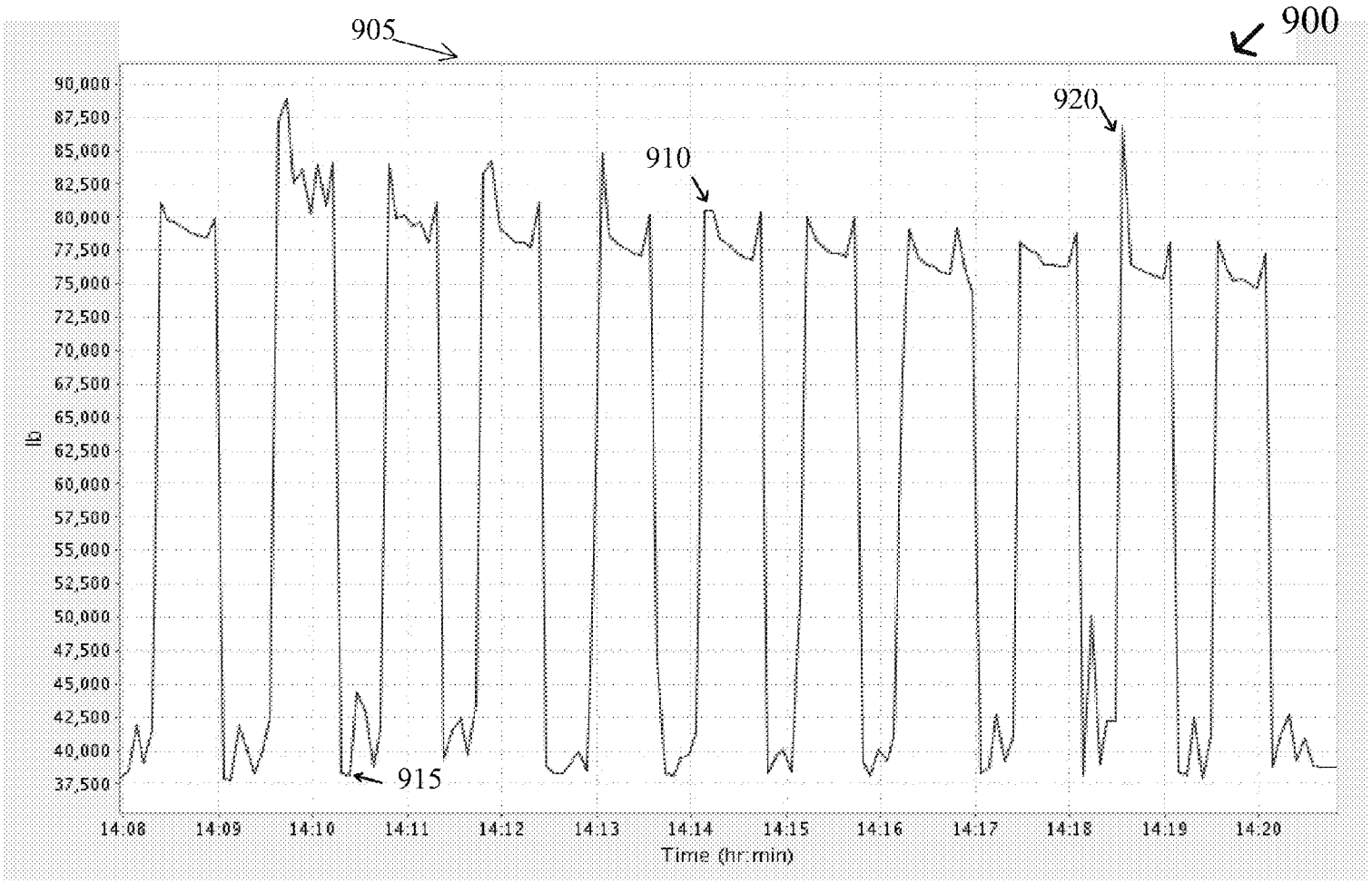
FIG. 9 is an exemplary display of a rig load data chart for determining rig load and/or hookload on a mobile repair unit according to one exemplary embodiment of the present invention.

In step 825, the rig load weight data is recorded and displayed at the computer 705. FIG. 9 is an illustration of an exemplary display 900 of a rig load data chart presenting the rig load weight data and used for determining the rig load of a mobile repair unit 20. Referring to FIG. 9, the exemplary display 900 includes a rig load data chart 905. The X-axis of the rig load data chart 905 represents time and the Y-axis represents rig load in pounds. Rig load can be measured at several places on the rig 20. For instance, rig load can be measured on each individual rig pad 92, on a transducer or sensor on the output side of the integrator on the pad weight indicator (Not Shown), on a strain gage placed on the mast of the rig 20 to measure compression in a derrick leg, on a dead line, line sensor, line diaphragm, sending diaphragm or cylinder (Not Shown). The rig load displayed in the rig load chart 905 is based on the total weight on the pads 92, not the load on the hook 38 ("hookload").

FIG. 9 presents the general patterns for rig load data curves during activities for pulling rods and tubing 62 out of a wellbore 58. The rig load chart 905 includes a series of rig load data points represented as a weight curve 910. While it appears from the weight curve 910 that the rig load data points are being recorded on a constant basis, it is possible to take the data points at intervals and generate the line based on averages over a period of data points. The rig load chart 905 presents data such as the weight of the rig 20, which can be determined by evaluating the valleys 915 of the data points. The chart 905 also presents spikes 920 of the rig load level. The amount of the spike 920 can be based on several factors, including, but not limited to, the speed at which the tubing 62 is being removed from the well 58, anomalies or wear within the wellbore 58, or problems with the tubing 62 in the wellbore 58. While some spiking of the weight data along the weight cure 910 is expected, if the spikes of load data is above certain predetermined levels, the higher than normal rig load levels can indicate that the tubing 62 is caught or stuck in the wellbore 58, there are problems with the wellbore 58, the operator is trying to remove the tubing 62 too quickly, and/or further pulling could damage the rig 20 or injure the workers once the tubing 62 "breaks loose" or the tubing 62 breaks off of the tubing string 62.

Returning to FIG. 8, the computer 705 determines the average weight of the rig load based on the data in the rig load chart 905 in step 830. In step 835, the computer 705 determines the rig load limit. In one exemplary embodiment, the rig load limit is the amount of load above the average weight of the rig load that the rig 20 can pull and still operate safely. For example, as long as the actual load received at the sensors 92 does not exceed the rig load limit, the rig 20 can continue to operate. However, if the sensors 92 read a load that is greater than or equal to the rig load limit, the pulling of the tubing 62 can be stopped by disengaging the clutch for the hoist 36. In one exemplary embodiment, the rig load limit is a constant value above the average weight for the rig load, for example a value between five and fifty thousand pounds. In another exemplary embodiment, the rig load limit is a percentage of the average rig load for the prior tubing pull that is added to that average rig load, for example between 1-50 percent. In yet another exemplary embodiment, the rig load limit is a percentage of the hookload that is added to the average rig load for the prior tubing pull, for example between 1-500% of the hookload. In this embodiment, the hookload can be determined by subtracting the rig weight on its own from the average rig load. The value of the rig weight on its own may be known, or may be determined by taking the value at the valley 915 of the data curve 910 for one of the prior tubing pulls.

In step 840, an inquiry is conducted to determine if the rig load level is above the rig load limit. The current rig load level may be determined at the sensor 92 or by monitoring the data curve 910 on the chart 905. If the rig load level is not above the rig load limit, the "NO" branch is followed back to step 825 to continue recording rig load data at the computer 705. However, if the rig load level is above the rig load limit, the "YES" branch is followed to step 845, where the computer 705 sends a signal to apply the brake and disengage the clutch of the hoist 36 and reduce the engine throttle or any combination thereof, thereby stopping any additional pulling of the tubing 62 out of the wellbore 58. In step 850, the computer 705 sends a signal to activate an alarm and records the overload event for subsequent analysis and training of the rig operator. The alarm may be audible, visual or both. Audible alarms include, but are not limited to, sirens, horns and the like. Visual alarms may include, but are not limited to, flashing lights, a light turning on, or a display of a message at the computer 705. The process then continues to the END step.

Figure 10:
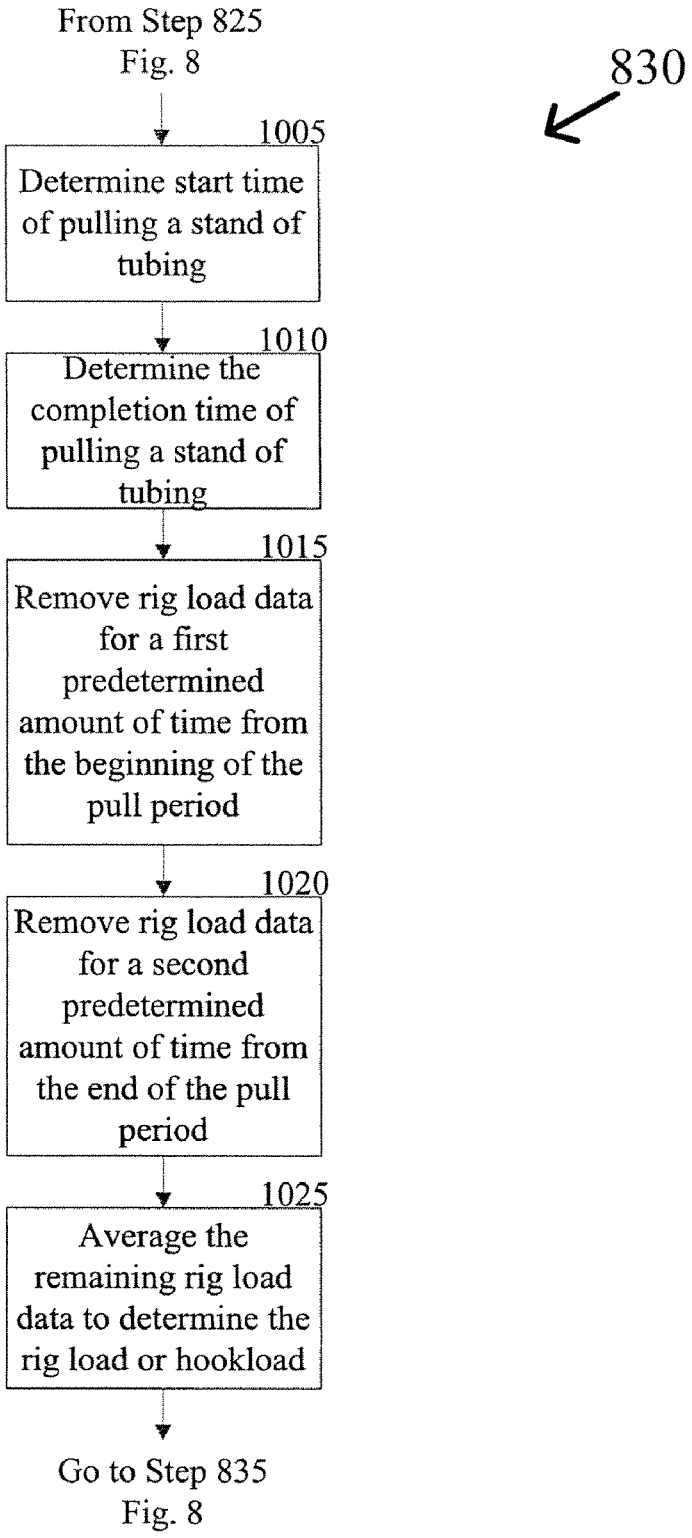
FIG. 10 is a flowchart of an exemplary process for determining the average rig load and/or hookload of a tubing string based on an evaluation of the rig load data chart according to one exemplary embodiment of the present invention.

FIG. 10, is a logical flowchart diagram illustrating the exemplary method 830 for determining the average rig load based on an evaluation of the rig load data chart 905 according to one exemplary embodiment of the present invention. Now referring to FIGS. 1, 5, 7, 8, 9, 10, and 11, the exemplary method 830 begins at step 1005, where a determination is made as to the start time for pulling a stand of tubing 62. In one exemplary embodiment, the start time for pulling is determined to be when the clutch of the hoist 36 is engaged, the weight is above the baseline weight, the block 38 is moving upward, and the slips are open, however, fewer than all of these elements and/or different elements may be analyzed to determine the start time of the pull.

Figure 11:
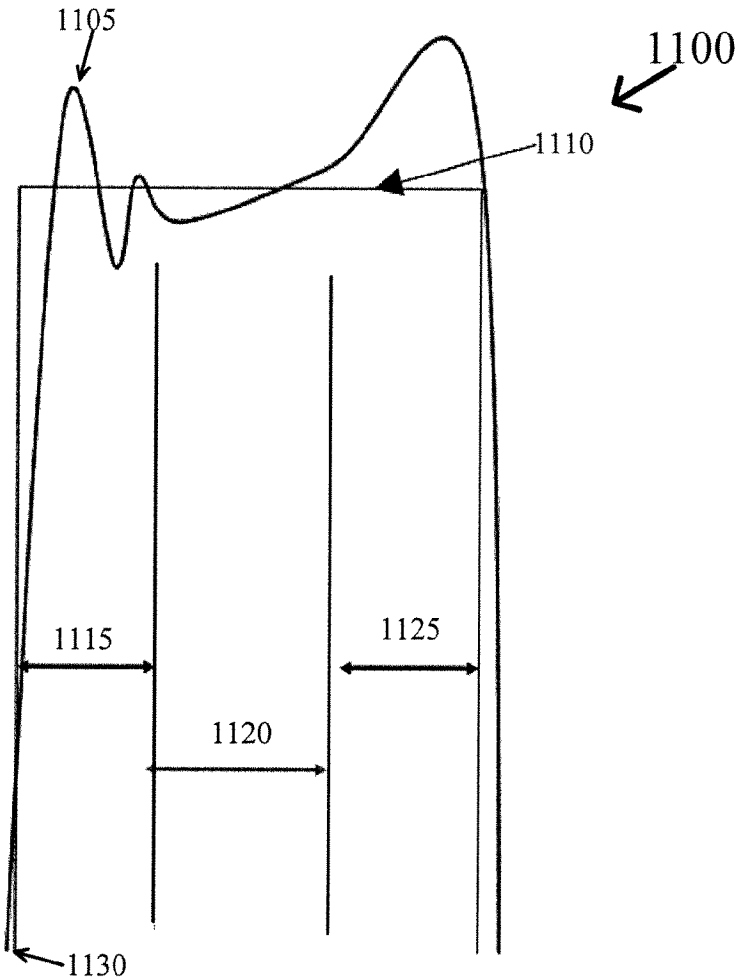
FIG. 11 is an exemplary display of a portion of the rig load data chart for a single pull of tubing used to determine the average rig load and/or hookload of the tubing string in accordance with the exemplary embodiment of FIG. 10.

A determination is made as to when the completion time for pulling a stand of tubing 62 has occurred in step 1010. In one exemplary embodiment, the time of completion occurs after the start time when the slips are closed. The time to pull a stand of tubing 62 generally takes approximately twelve seconds; however, shorter and longer periods are within the scope of this invention. FIG. 11, presents the a display 1100 of the general pattern for a rig load data curve 1110 while pulling a single stand of tubing 62 from the starting point to the completion point from the wellbore 58. FIG. 11 also includes a static expected weight curve 1110 superimposed onto the rig load data curve 1105. The static expected weight curve 1110 is a best case scenario for load generated at the rig load sensors 92 during the pulling of a stand of tubing 62. The rig load data curve 1105 can be divided into multiple intervals, in order to separate good data from data containing a large amount of error. In one exemplary embodiment, the rig load data 1105 can be divided up into three intervals: the first interval 1115, the second interval 1120, and the third interval 1125; however, greater or fewer intervals are within the scope of this invention.

During the first interval 1115, the curve 1105 is reflective of Hooke's law, or the spring action of the tubing 62. If the operator pulls off the slips too fast or has a running start before the elevators engage the tubing collar, the peak at point 1105 will increase above the actual weight due to momentum. Additionally, not allowing the hoist chain sprocket and right angle drive (Not Shown) to come to a stop prior to engaging the clutch for the hoist 36 will cause the peak at 1105 to increase as well. In one exemplary embodiment, the first time interval will be between one and five seconds, however adjustments to the interval length may be made based on the length of tubing 62 remaining on the string, the amount of acceleration, and the condition of the wellbore 58. The second interval 1120 is the most reflective of the true rig load. The slope of the rig load data curve 1105 during the second interval 1120 is normally positive because the block speed is increasing, however, the slope can be zero if the block speed is constant. The third interval 1125 is the interval with the fastest ascending tubing 62 speed. The data 1105 during the third interval can be reflective of swabbing the hole. The increase in the apparent weight during the third interval 1125 is typically due to drag and speed of the tubing 62.

Returning to FIG. 10, the rig load data from the first interval 1115, or first predetermined amount of time, after the beginning of the pull of the tubing string 62 is removed from the average rig load analysis in step 1015. In one exemplary embodiment, the first predetermined amount of time is between one and five seconds. In an alternative embodiment, the first predetermined amount of time is a percentage of the entire time period to pull a single stand of tubing 62 from the start point to the completion point. In this exemplary embodiment, the percentage can be between 1-40 percent of the entire time period. In step 1020, the rig load data for the second predetermined amount of time, or third interval 1125, is removed from the analysis of the average rig load. If the third interval is a specific amount of time, in one example between one and five seconds, the data removed will be determined from the completion point for the string pull and working backwards from there. However, in an alternative embodiment, the third interval 1125 can be a percentage of the overall time period to pull the stand of tubing 62. In this exemplary embodiment, the percentage can be between 1-40 percent of the entire time period. In step 1025, the computer 705 averages the remaining rig load data 1105 to determine an average rig load. In one exemplary embodiment, the remaining rig load data includes only the data 1105 plotted during the second interval 1120. The process then continues to step 835 of FIG. 8.

Figure 12:
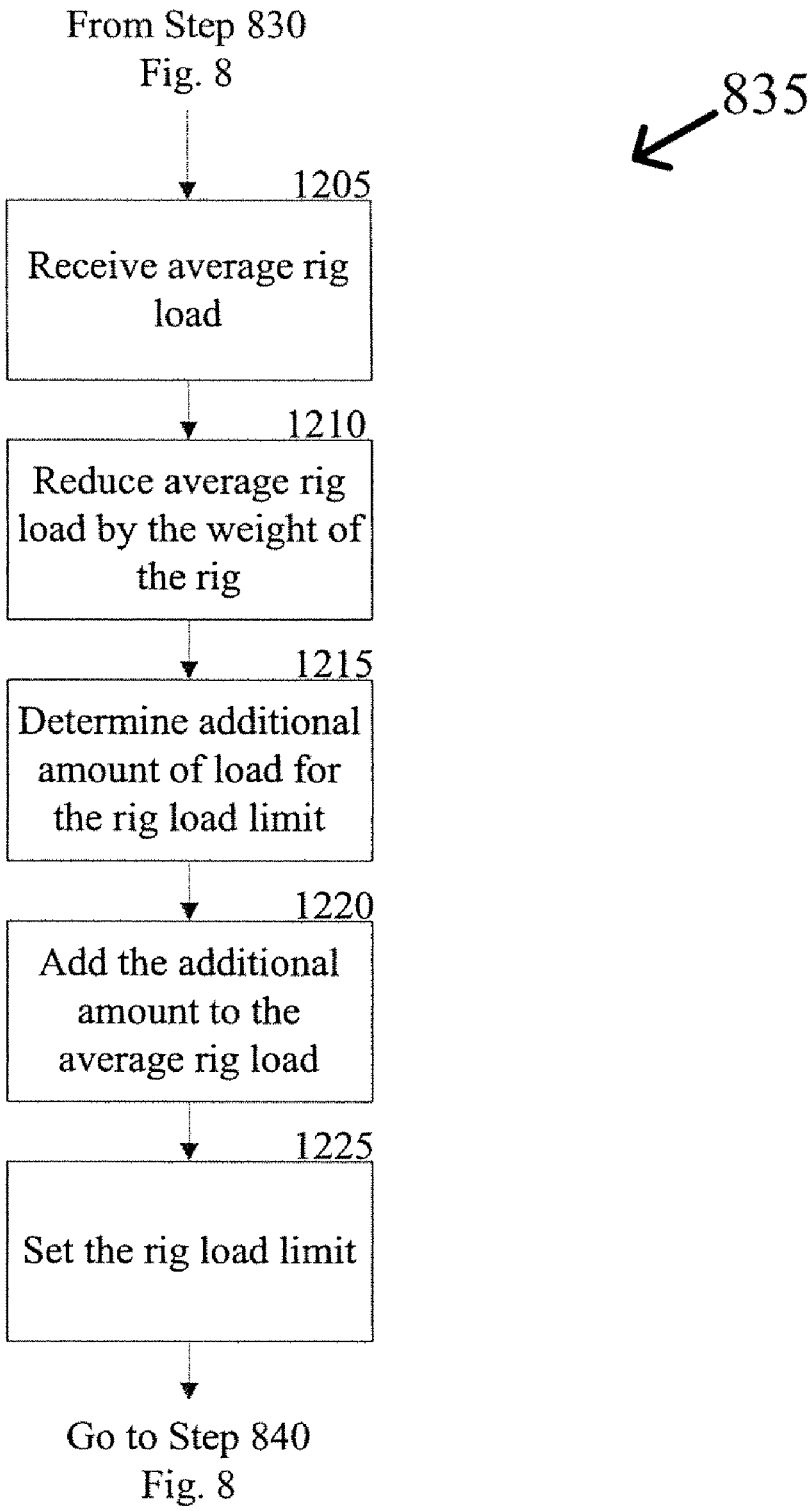
FIG. 12 is a flowchart of an exemplary process for determining the rig load and/or hookload limit based on an evaluation of the rig load data chart according to one exemplary embodiment of the present invention.

FIG. 12, is a logical flowchart diagram illustrating the exemplary method 835 of FIG. 8 for determining the rig load limit based on an evaluation of the rig load data chart 905 according to one exemplary embodiment of the present invention. Now referring to FIGS. 1, 5, 7, 8, 9, 11, and 12 the exemplary method 835 begins at step 1105, where the average rig load is received. In one exemplary embodiment, the average rig load is determined by the computer 705; however, the average rig load can be manually entered into the computer 705 by the operator of the rig 20.

The average rig load is reduced by the weight of the rig 20 in step 1210. In one exemplary embodiment, the weight of the rig can be determined prior to pulling the tubing 62 or manually input by the rig operator. In another exemplary embodiment, the rig weight can be determined by receiving the minimum rig load data point 915 of FIG. 9, on the prior pull of a stand of tubing 62 and that amount can be deducted from the average rig load to determine the hookload or weight of tubing 62 in the tubing string 62. In step 1215, an additional load amount is determined. In one exemplary embodiment, the additional load amount is a consistent amount of weight, for example, between five thousand and fifty thousand pounds. In another exemplary embodiment, the amount of additional load is based on a predetermined percentage of the hookload, for example between 1 and 500 percent of the hookload. In yet another exemplary embodiment, the amount of additional load is based on a predetermined percentage of the average rig load, for example between 1-50 percent of average rig load. In this exemplary embodiment, since the additional load is based on the average rig load, there is no need to determine the weight of the rig or to subtract the weight of the rig from the average rig load. In each of these embodiments, the additional load can be considered a load safety factor.

In step 1220, the load safety factor is added to the average rig load for the most recent pull of a stand of tubing 62. The sum of the load safety factor and the average rig load are set as the rig load limit for the pull of the next stand of tubing 62. The process continues for each subsequent stand of tubing 62 until all of the tubing 62 has been removed from the wellbore 58. The process continues from step 1225 to step 840 of FIG. 8.

Figure 13:
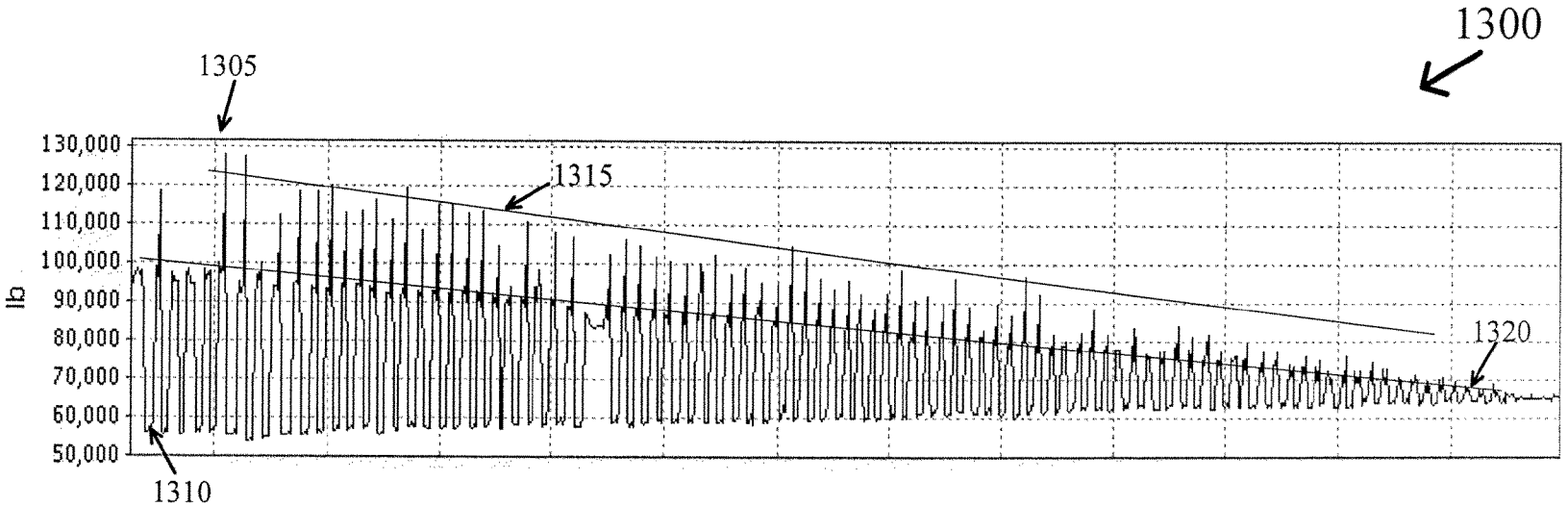
FIG. 13 is an exemplary display of the rig load data chart incorporating the average hookload and hookload limit in accordance with one exemplary embodiment of the present invention.

FIG. 13 is an illustration of an exemplary display 1300 of a rig load data chart 1305 presenting the general patterns for exemplary rig load data curves at the computer 705 while stands of tubing 62 are being removed from the wellbore 58 in accordance with one exemplary embodiment of the present invention. Now referring to FIGS. 9, 10, 12, and 13, the exemplary display 1300 includes a rig load data chart 1305 substantially as described with regards to FIG. 9. The rig load data chart includes rig load data 1310 presented as a data curve; however, those of ordinary skill in the art will recognize that the data 1310 could also be individual points plotted on a graph without connection in the manner of a curve. The chart 1305 also includes a series of data points 1320, substantially shown in the shape of a straight line, representing the average rig load determined generally as described in FIG. 10. Furthermore, the chart 1305 includes a series of data points 1315, substantially presented in the shape of a straight line, representing the rig load limit, which is determined as generally described in FIG. 12. By superimposing the average rig load 1320 and the rig load limit 1315 onto the chart 1305 of rig load data 1310 an operator can better determine the number of times that he has pushed the rig load over the rig load limit 1315.

Figure 14:
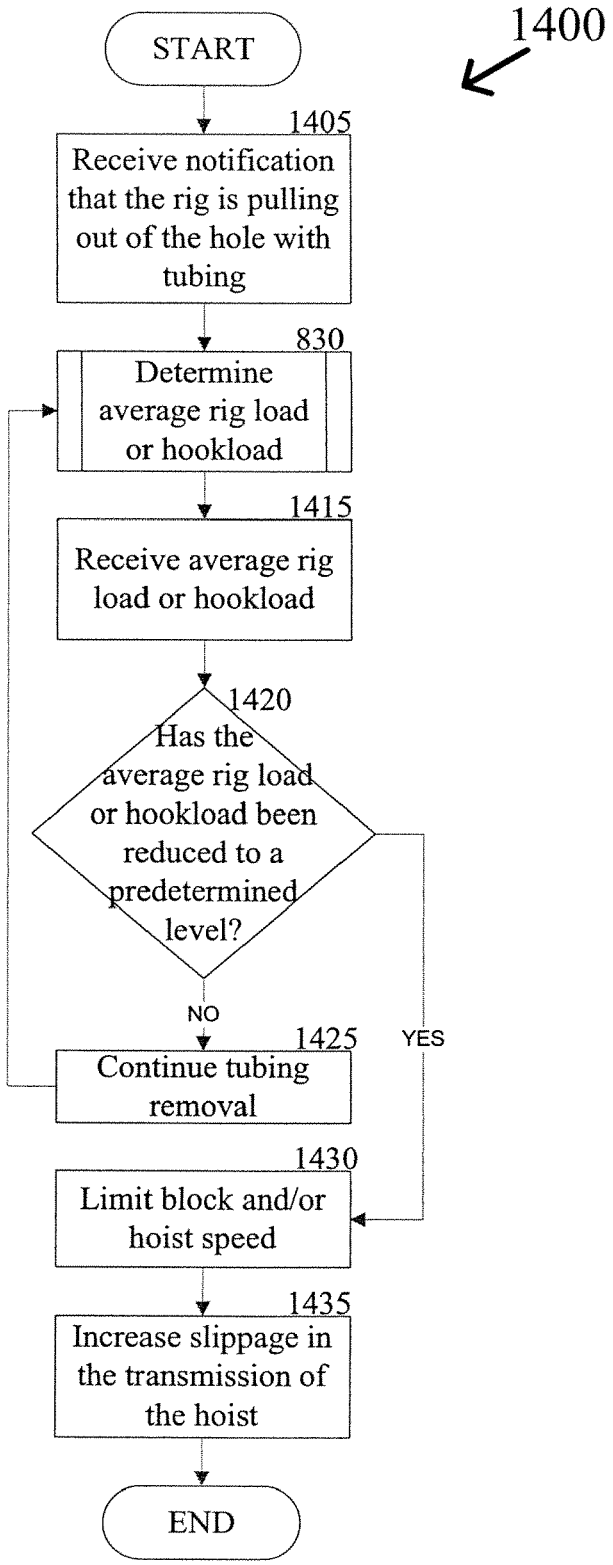
FIG. 14 is a flowchart of an exemplary process for limiting block speed during tubing removal by evaluating the exemplary rig load data charts according to one exemplary embodiment of the present invention.

FIG. 14 is a logical flowchart diagram illustrating an exemplary method 1400 for limiting block speed during tubing 62 removal by evaluating the exemplary rig load data in the rig load data chart according to one exemplary embodiment of the present invention. Referring to FIGS. 1, 5, 7, 8, 10, and 14, the exemplary method 1400 begins at the START step and continues to step 1405, where the computer 705 receives notification that the rig 20 is pulling out of the wellbore 58 with tubing 62. The notification can take the form of steps 805-820 of FIG. 8. In another exemplary embodiment, the notification can be based on the rig operator selecting the pull activity 715 at the computer 705.

The average rig load is determined in step 830 and is described in greater detail in FIG. 10. In step 1415, the computer 705 receives the average rig load for the most recent pull of a stand of tubing 62. In step 1420, an inquiry is conducted to determine if the average rig load has reached a predetermined level. In one exemplary embodiment, once the tubing string 62 becomes light enough, the risk of catastrophic events due to pulling the string of tubing 62 out of the wellbore 58 too quickly greatly increases. In one exemplary embodiment, the predetermined level can be set at a hookload of between one and fifty thousand pounds. The hookload can be added to the known or expected weight of the rig 20 to insert the predetermined level as a rig load, for example approximately 42,500 pounds in the example of FIG. 9 (hookload of 5000 pounds plus rig weight of 37,500 pounds). Alternatively, the computer 705 can determine the average hookload during each tubing pull by subtracting the rig weight from the average rig load and can compare the average hookload to the predetermined level of hookload.

If the average rig load has not reached a predetermined level, then the "NO" branch is followed to step 1425, where additional stands of tubing 62 are removed with the operator having the complete range of speed control available. The process then returns to step 830 to determine the average rig load for the most current tubing pull. If the average rig load has reached the predetermined level, then the "YES" branch is followed to step 1430, where the computer 705 transmits a signal to limit block speed while pulling the remaining stands of tubing 62. The signal generally acts as a governor for the drive of the hoist 36. In one exemplary embodiment, the standard speed for removal of tubing 62 is approximately six feet per second and the limited block speed has a maximum of anywhere between one-half and four feet per second after the predetermined rig load is reached. In step 1435, the slippage in the transmission 32 can also be increased for the hoist 36. In one exemplary embodiment, the slippage in the transmission 32 can be increased by opening a solenoid valve (Not Shown) on the first transmission 32 case thereby relieving hydraulic pressure in the transmission lockup system. The reduction in hydraulic pressure induces slippage into the first transmission 32 and thereby offers another level of safety in case the rig 20 pulls tubing 62 that unexpectedly gets hung up on something in the wellbore 58. Additionally, the air pressure applied to the hoist clutch bladder can be reduced, thereby inducing slippage in the hoist clutch. In one exemplary embodiment, the clutch bladder generally is provided with an air pressure in excess of one hundred pounds per square inch when a hoist 36 is operating normally with a load. This air pressure can be reduced to induce the slippage described above and provide another level of safety in case the tubing 62 is hung up in the wellbore 58. The process then continues to the END step. While the present method has been described generally in terms of the rig load, those of ordinary skill in the art will recognize that, with minor modifications as discussed herein, the hookload could be substituted for the rig load in most instances.

Figure 15:
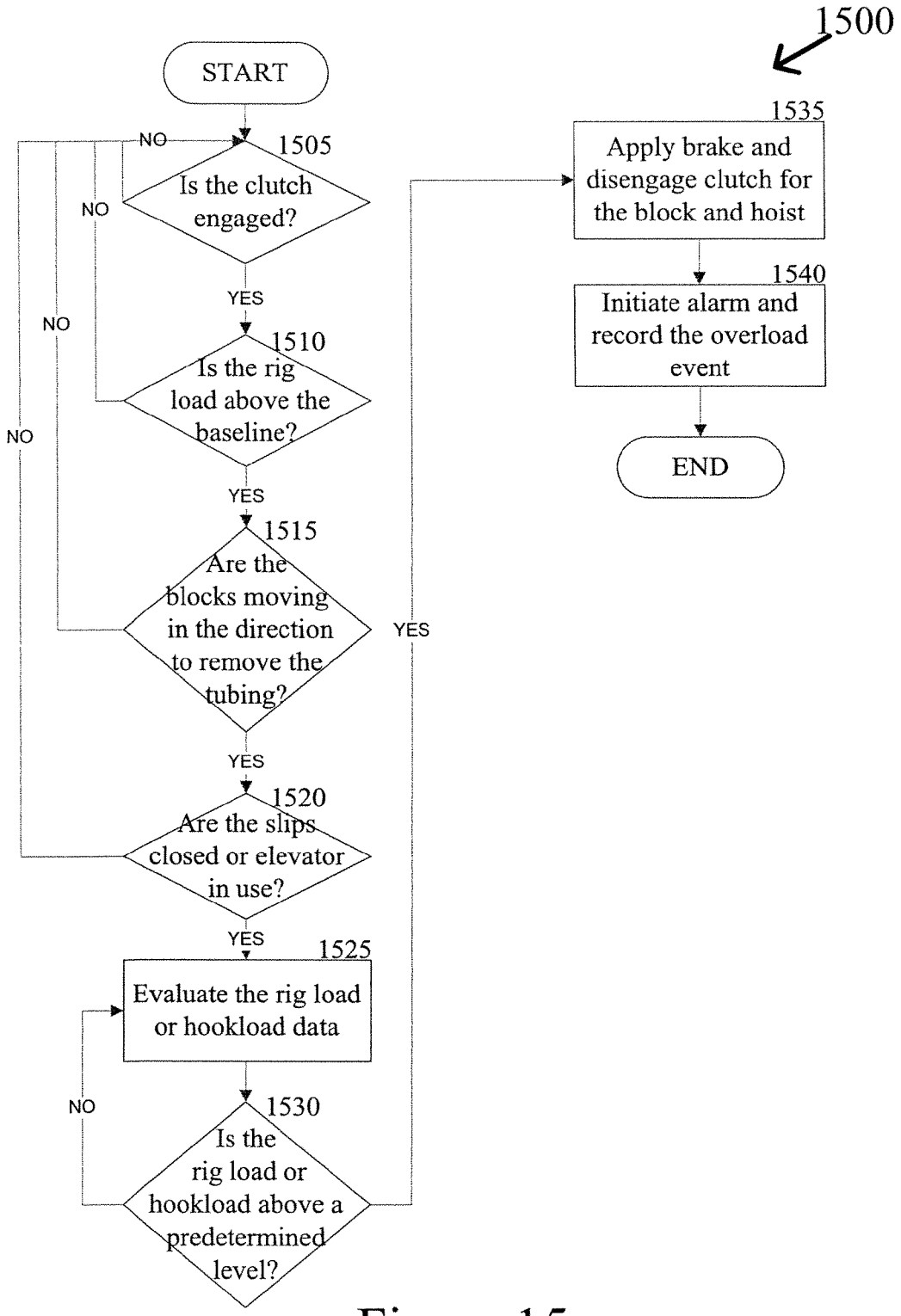
FIG. 15 is a flowchart of an exemplary process for preventing the pull of a stand of tubing before the tubing has been disengaged from the remaining tubing in the wellbore according to one exemplary embodiment of the present invention.

FIG. 15 is a logical flowchart diagram illustrating an exemplary method 1500 for preventing the pull of a stand of tubing 62 before the tubing 62 has been disengaged from the remaining tubing 62 in the wellbore 58 according to one exemplary embodiment of the present invention. Referring to FIGS. 1, 5, 7, 9, and 15, the exemplary method 1500 begins at the START step and continues to step 1505, where an inquiry is conducted to determine if the clutch of the first transmission 32 driving the variable speed hoist 36 is engaged. If the clutch is not engaged, the "NO" branch is followed back to step 1505 until a determination is made that the clutch is engaged. Otherwise, the "YES" branch is followed to step 1510.

In step 1510, an inquiry is conducted to determine if the rig load weight is above the baseline level. The baseline weight is generally at a level that is marginally above the weight of the rig 20 itself. In one exemplary embodiment, the baseline weight is approximately 40,000 pounds. However, those of skill in the art will recognize that this amount may be easily changed based on other factors, as described above. In an alternative embodiment, there may not be a need for an evaluation of the baseline weight, as any rig load limit weight will generally be above the baseline weight. If the weight is not above the baseline weight, the "NO" branch is followed back to step 1505. On the other hand, if the rig load weight is above the baseline weight, the "YES" branch is followed to step 1515.

In step 1520, an inquiry is conducted to determine if the blocks 38 are moving in the direction to remove tubing 62 from the wellbore 58. In one exemplary embodiment, the direction of the blocks 38 can be analyzed by positioning an encoder at the hoist 36 or at another position along the line coupled to the block 38. If the block 38 is not moving in the direction for removing the tubing 62, the "NO" branch is followed to step 1505. Otherwise, the "YES" branch is followed to step 1520. In step 1520, an inquiry is conducted to determine if the slips (Not Shown) at the wellhead 186 are closed during a tubing pull or if the elevator (Not Shown) is in use during a rod pull. If the slips are open or the elevator is not in use for the rod pull, the "NO" branch is followed to step 1505. Otherwise, the "YES" branch is followed to step 1525.

In step 1525, the computer 705 evaluates the rig load data. The computer 705 can evaluate the raw data from the sensor 92, data that has been "cleansed," or it can review the data points on the chart 905. In step 1530, an inquiry is conducted to determine if the rig load is above a predetermined level. In one exemplary embodiment, the predetermined level is a hookload of between two and ten thousand pounds or a rig load having a predetermined level of between two and ten thousand pounds plus the weight or estimated weight of the rig 20. As described above, the weight of the rig 20 can be manually input at the computer 705 or determined based on an evaluation of the lower limits of the rig load data 915 on the rig load data chart 905.

If the rig load is not above the predetermined level, the "NO" branch is followed to step 1525 to continue evaluation of the rig load data. On the other hand, if the rig load is above the predetermined level, the "YES" branch is followed to step 1535, where the computer 705 transmits a signal to apply the brake and disengage the clutch for the hoist 36 and block 38, thereby stopping any additional pulling of the tubing 62 out of the wellbore 58. An alarm is initiated and an overload event is recorded in step 1540 for subsequent analysis and training of the rig operator. The alarm may be audible, visual or both. Audible alarms include, but are not limited to, sirens, horns and the like. Visual alarms may include, but are not limited to, flashing lights, a light turning on, or a display of a message at the computer 705. The process continues from step 1540 to the END step.

Although the invention is described with reference to preferred embodiments, it should be appreciated by those skilled in the art that various modifications are well within the scope of the invention. Therefore, the scope of the invention is to be determined by reference to the claims that follow. From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those or ordinary skill in the art, and ways of constructing other embodiments of the present invention will suggest themselves to practitioners of the art. Therefore, the scope of the present invention is to be limited only by any claims that follow.

I claim:

1. A method for preventing the pulling of a stand of pipe away from a pipe string while the stand of pipe is being disengaged from the pipe string, comprising the steps of:

determining if a stand of pipe is being disengaged from a pipe string;

receiving load data while disengaging the stand of pipe from the pipe string;

determining if the load data is above a predetermined level while disengaging the stand of pipe from the pipe string; and automatically disengaging a clutch for a drive system raising the stand of pipe based on a positive determination that the load is above the predetermined level.

2. The method of claim 1, wherein determining if a stand of pipe is being disengaged from a pipe string comprises the steps of:

determining that a clutch on a drive system for a well service rig raising the stand of pipe is engaged;

determining that the drive system is moving in a direction for raising a stand of pipe; and determining that the slip is in a closed position.

3. The method of claim 1, wherein determining if a stand of pipe is being disengaged from a pipe string comprises the steps of:

determining that a clutch on a drive system for a well service rig raising the stand of pipe is engaged;

determining that the drive system is moving in a direction for raising a stand of pipe; and determining that an elevator is engaging the pipe string.

4. The method of claim 1, further comprising the step of recording the current load as an overload event at a computer on the rig based on a positive determination that the load is above a predetermined level.

5. The method of claim 1, further comprising the step of reducing the engine throttle for the engine driving a block based on a positive determination that the average load is below a predetermined level.

6. The method of claim 1, further comprising the step of activating an alarm based on a positive determination that the load is above a predetermined level.

7. The method of claim 1, wherein the load is a hookload and the predetermined level of hookload is between one thousand and ten thousand pounds.

8. The method of claim 1, wherein the load is a rig load and the predetermined level of rig load is the sum of a weight for the rig and between one thousand and ten thousand pounds.

9. A method for preventing the pulling of a stand of pipe away from a pipe string while the stand of pipe is being disengaged from the pipe string, comprising the steps of:

determining if a stand of pipe is being disengaged from a pipe string comprising the steps of:

determining that a clutch on a drive system for a well service rig raising the stand of pipe is engaged; and determining that a slip is in a closed position;

receiving load data while disengaging the stand of pipe from the pipe string;

determining if the load data is above a predetermined level while disengaging the stand of pipe from the pipe string; and automatically disengaging the clutch for a drive system raising the stand of pipe based on a positive determination that the load is above the predetermined level.

10. The method of claim 9, wherein the step of determining if a stand of pipe is being disengaged from a pipe string further comprises the step of determining that the drive system is moving in a direction for raising a stand of pipe.

11. The method of claim 9, further comprising the step of recording the current load as an overload event at a computer on the rig based on a positive determination that the load is above a predetermined level.

12. The method of claim 9, further comprising the step of reducing an engine throttle for the engine driving a block based on a positive determination that the average load is below a predetermined level.

13. The method of claim 9, further comprising the step of activating a visual alarm based on a positive determination that the load is above a predetermined level.

14. The method of claim 9, further comprising the step of activating a audible alarm based on a positive determination that the load is above a predetermined level.

15. The method of claim 9, wherein the load is a hookload and the predetermined level of hookload is between one thousand and ten thousand pounds.

16. The method of claim 9, wherein the load is a rig load and the predetermined level of rig load is the sum of a weight for the rig and between one thousand and ten thousand pounds.

17. A method for preventing the pulling of a stand of pipe away from a pipe string while the stand of pipe is being disengaged from the pipe string, comprising the steps of:

determining if a stand of pipe is being disengaged from a pipe string comprising the steps of:

determining that a clutch on a drive system for a well service rig raising the stand of pipe is engaged; and determining that an elevator is engaged the pipe string;

receiving load data while disengaging the stand of pipe from the pipe string;

determining if the load data is above a predetermined level while disengaging the stand of pipe from the pipe string; and automatically disengaging the clutch for a drive system raising the stand of pipe based on a positive determination that the load is above the predetermined level.

18. The method of claim 17, further comprising the step of recording the current load as an overload event at a computer on the rig based on a positive determination that the load is above a predetermined level.

19. The method of claim 17, further comprising the step of activating a visual alarm based on a positive determination that the load is above a predetermined level.

20. The method of claim 17, further comprising the step of activating a audible alarm based on a positive determination that the load is above a predetermined level.

* * * * *